US009390668B2

(12) United States Patent
Matsushima et al.

(10) Patent No.: US 9,390,668 B2
(45) Date of Patent: Jul. 12, 2016

(54) LIQUID-CRYSTAL DISPLAY DEVICE AND ELECTRONIC APPARATUS

(71) Applicant: Japan Display Inc., Tokyo (JP)

(72) Inventors: Toshiharu Matsushima, Tokyo (JP); Chihiro Tanaka, Tokyo (JP)

(73) Assignee: Japan Display Inc., Tokyo (JP)

( * ) Notice: Subject to any disclaimer, the term of this patent is extended or adjusted under 35 U.S.C. 154(b) by 96 days.

(21) Appl. No.: 14/220,933

(22) Filed: Mar. 20, 2014

(65) Prior Publication Data

US 2014/0292835 A1 Oct. 2, 2014

(30) Foreign Application Priority Data

Mar. 29, 2013 (JP) ..... 2013-074417

(51) Int. Cl.
*G09G 5/10* (2006.01)
*G09G 3/36* (2006.01)

(52) U.S. Cl.
CPC ..... *G09G 3/3648* (2013.01); *G09G 3/3614* (2013.01); *G09G 2320/0252* (2013.01); *G09G 2320/041* (2013.01); *G09G 2340/0435* (2013.01)

(58) Field of Classification Search
None
See application file for complete search history.

(56) References Cited

U.S. PATENT DOCUMENTS

2006/0256141 A1* 11/2006 Maruyama ..... G09G 3/2022 345/690
2007/0279374 A1* 12/2007 Kimura ..... G02F 1/133555 345/102
2008/0158443 A1* 7/2008 Shiomi ..... G09G 3/3648 348/790
2010/0207859 A1* 8/2010 Tanaka ..... G09G 3/3648 345/89
2012/0162229 A1* 6/2012 Yamato ..... G09G 3/2011 345/428

FOREIGN PATENT DOCUMENTS

JP 2007-219392 8/2007
JP 2010-109578 5/2010
WO 2007/074560 7/2007

OTHER PUBLICATIONS

Japanese Office Action issued Mar. 1, 2016 in corresponding Japanese Application No. 2013-074417.

* cited by examiner

*Primary Examiner* — Joseph Feild
*Assistant Examiner* — Henok Heyi
(74) *Attorney, Agent, or Firm* — K&L Gates LLP

(57) ABSTRACT

According to an aspect, a liquid-crystal display device includes: a liquid crystal layer; and a control unit that controls a display operation. The control unit performs a first display control mode when a response speed of the liquid crystal layer is equal to or higher than a predetermined speed and performs a second display control mode when the response speed of the liquid crystal layer is lower than the predetermined speed. In the first display control mode, the control unit executes a display control at a first frame rate with which a number of frames per unit time is equal to a predetermined number. In the second display control mode, the control unit executes a display control at a second frame rate obtained by dividing the number of frames at the first frame rate by an integer equal to or larger than 2.

3 Claims, 9 Drawing Sheets

FIG.5

D1

Ta

T

| FRAME RATE 60 Hz | VOLTAGE VALUE |
|---|---|
| 1 | $Vd_1$ |
| 2 | $Vd_2$ |
| 3 | $Vd_3$ |
| 4 | $Vd_4$ |
| ⋮ | ⋮ |
| 59 | $Vd_{59}$ |
| 60 | $Vd_{60}$ |
| ⋮ | ⋮ |

FIG.6

D2

Tb

T

| FRAME RATE 30 Hz | VOLTAGE VALUE |
|---|---|
| 1 | $Vd_1$ |
| 2 | $Vd_2$ |
| ⋮ | ⋮ |
| 30 | $Vd_{30}$ |
| ⋮ | ⋮ |

LIQUID-CRYSTAL DISPLAY DEVICE AND ELECTRONIC APPARATUS

CROSS REFERENCES TO RELATED APPLICATIONS

The present application claims priority to Japanese Priority Patent Application JP 2013-074417 filed in the Japan Patent Office on Mar. 29, 2013, the entire content of which is hereby incorporated by reference.

BACKGROUND

1. Technical Field

The present disclosure relates to a liquid-crystal display device and an electronic apparatus.

2. Description of the Related Art

Liquid-crystal display devices include transmissive-type liquid-crystal display devices that display an image by using transmission light from a backlight provided on a backside of a screen. Some of this type of liquid-crystal display devices control brightness and darkness of a pixel with 0 to 255 gradations (so-called "256 gradation" or "8 bit display") (see Japanese Patent Application Laid-Open No. 2007-219392). In the liquid-crystal display device, when an ambient temperature is low, a response speed of a liquid crystal is decreased. Therefore, in order to improve the response speed of the liquid crystal, the liquid-crystal display device performs so-called "overdrive" in which a driving voltage for driving the liquid crystal is set to a voltage higher than a normal driving voltage.

Some liquid-crystal display devices improve the responsiveness of the liquid crystal by using a range that exhibits a fast response of the liquid crystal, when the liquid-crystal display device is used under an ambient temperature that decreases the responsiveness of the liquid crystal (see Japanese Patent Application Laid-Open No. 2010-109578). Specifically, in this type of liquid-crystal display device, a range that exhibits a fast response of the liquid crystal is set such that a black level becomes 15% of brightness of the liquid-crystal display device and a white level becomes 85% of the brightness of the liquid-crystal display device.

In this manner, when the response speed of the liquid crystal is decreased in a low ambient temperature, the liquid-crystal display device improves the response speed of the liquid crystal by performing an overdrive that applies a driving voltage higher than a target driving voltage corresponding to a target gradation in order to render a gradation of a pixel to meet a target gradation. In this case, an application time of the driving voltage applied at the time of performing the overdrive is increased as the response speed of the liquid crystal is decreased. The liquid-crystal display device performs a display operation at a frame rate with which the number of frames per unit time is equal to a predetermined value, and applies a predetermined driving voltage for each frame cycle. Therefore, when the application time of the driving voltage is increased at the time of performing the overdrive, the liquid-crystal display device needs to increase the number of frames to be applied with the driving voltage. As a result, because the number of frames used in the overdrive is increased, a load on a driving circuit unit that drives each pixel is also increased.

As described above, there is a need for a liquid crystal display device that can improve the display quality at the low ambient temperature, and an electronic apparatus including the same.

SUMMARY

According to an aspect, a liquid-crystal display device includes: a pixel electrode provided for each pixel; a common electrode for supplying a common potential to the pixel; a liquid crystal layer arranged between the pixel electrode and the common electrode; a driving circuit unit that applies a driving voltage between the common electrode and the pixel electrode for each frame cycle; a status detection unit that detects a status of a response speed of the liquid crystal layer; and a control unit that controls a display operation for displaying the pixel by controlling the driving voltage applied by the driving circuit unit for each frame cycle. The control unit performs a first display control mode when a response speed of the liquid crystal layer is equal to or higher than a predetermined speed and performs a second display control mode when the response speed of the liquid crystal layer is lower than the predetermined speed, based on a detection result from the status detection unit. In the first display control mode, the control unit executes a display control at a first frame rate with which a number of frames per unit time is equal to a predetermined number and applies the driving voltage for each frame cycle at the first frame rate. In the second display control mode, the control unit executes a display control at a second frame rate obtained by dividing the number of frames at the first frame rate by an integer equal to or larger than 2, applies the driving voltage for each frame cycle at the second frame rate, and sets the driving voltage to be applied to a voltage higher than a target driving voltage corresponding to a target gradation of the pixel.

According to another aspect, an electronic apparatus includes the liquid-crystal display device.

Additional features and advantages are described herein, and will be apparent from the following Detailed Description and the figures.

BRIEF DESCRIPTION OF THE FIGURES

FIG. 5 is an explanatory diagram of an example of normal-temperature display control data;

FIG. 6 is an explanatory diagram of an example of low-temperature display control data;

DETAILED DESCRIPTION

Modes (hereinafter, "embodiments") for implementing the technique of the present disclosure will be described below in detail with the following procedures with reference to the accompanying drawings in the order as follows.

Figure 1:
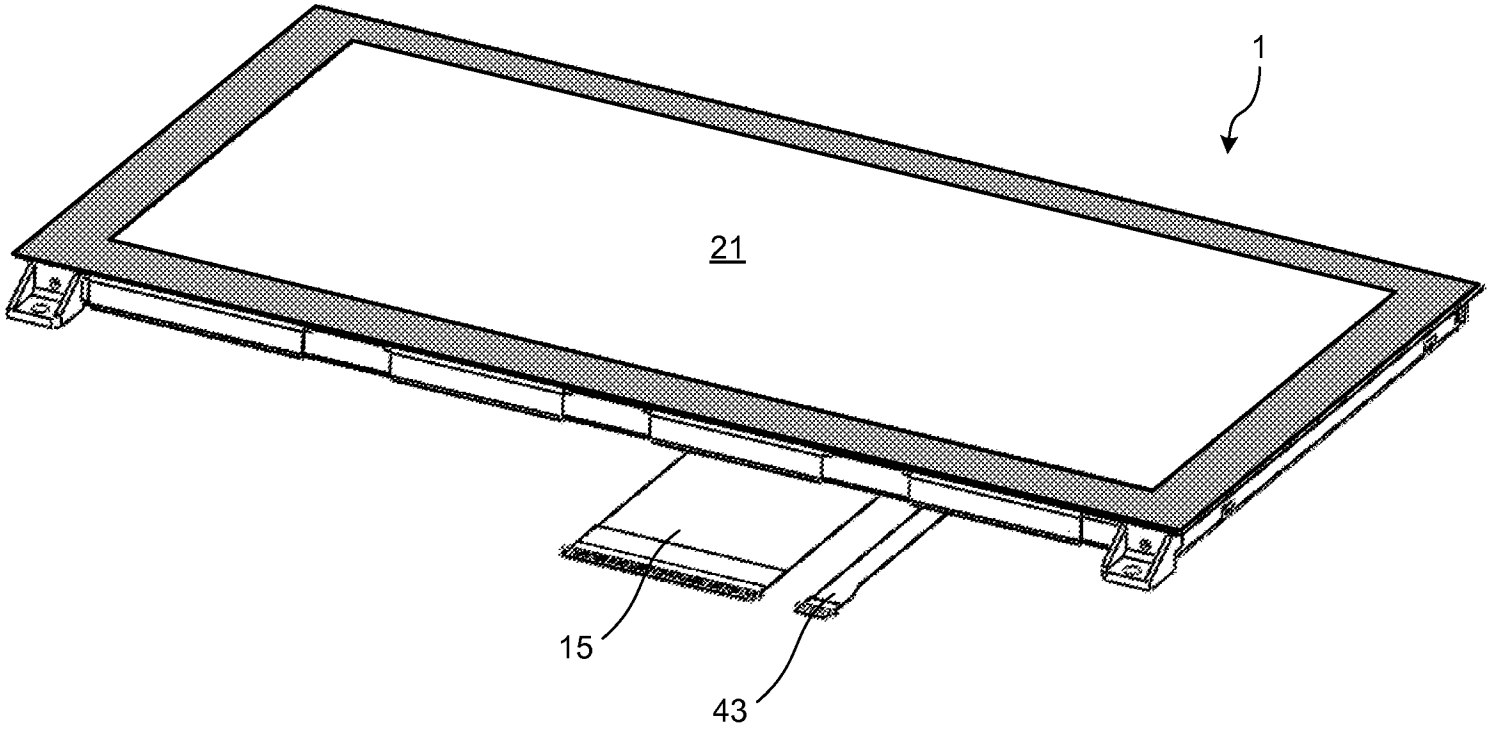
FIG. 1 is an overall perspective view of a liquid-crystal display device according to an embodiment of the present disclosure.
Figure 2:
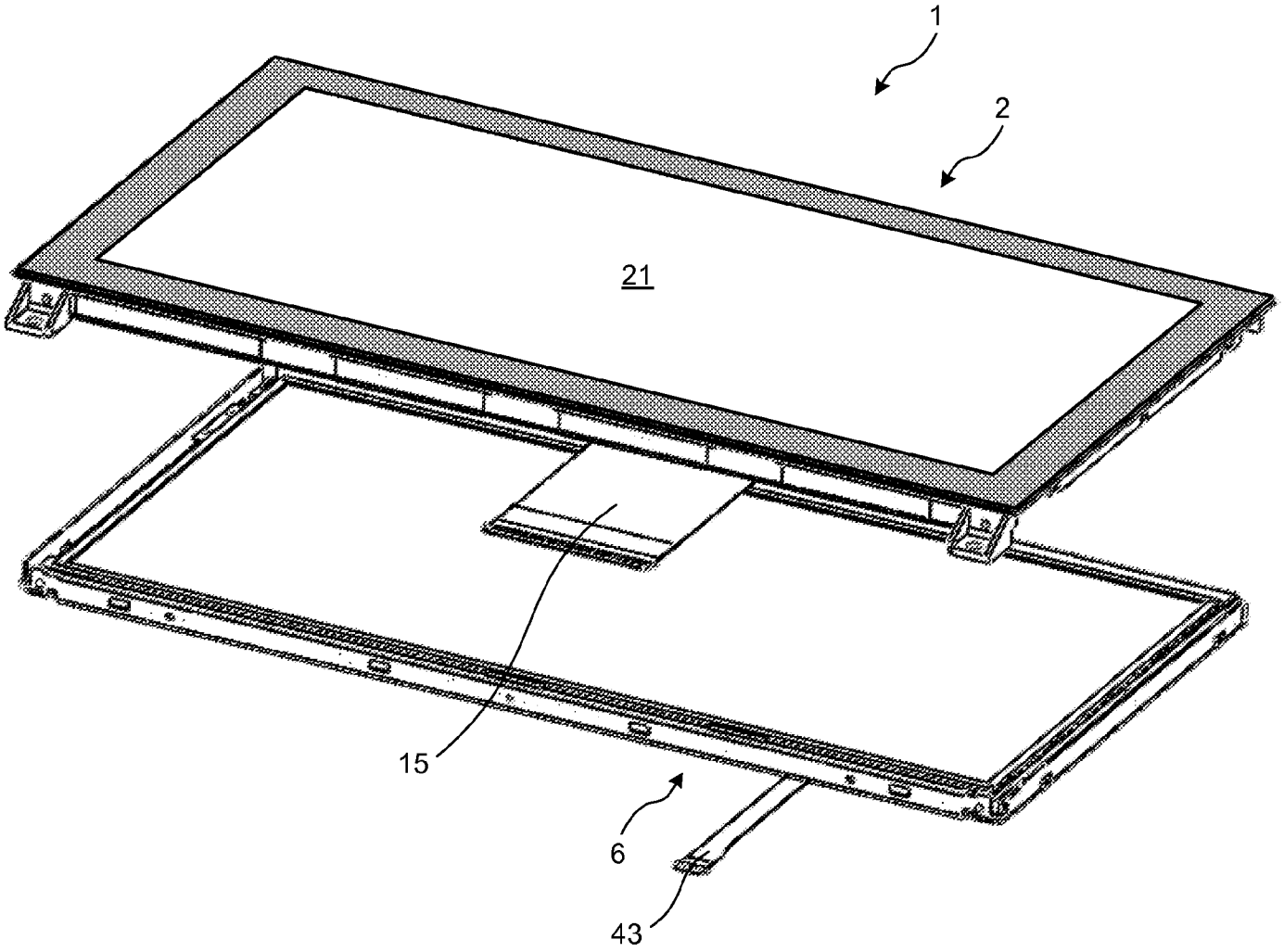
FIG. 2 is an exploded perspective view of the liquid-crystal display device according to the embodiment.
Figure 3:
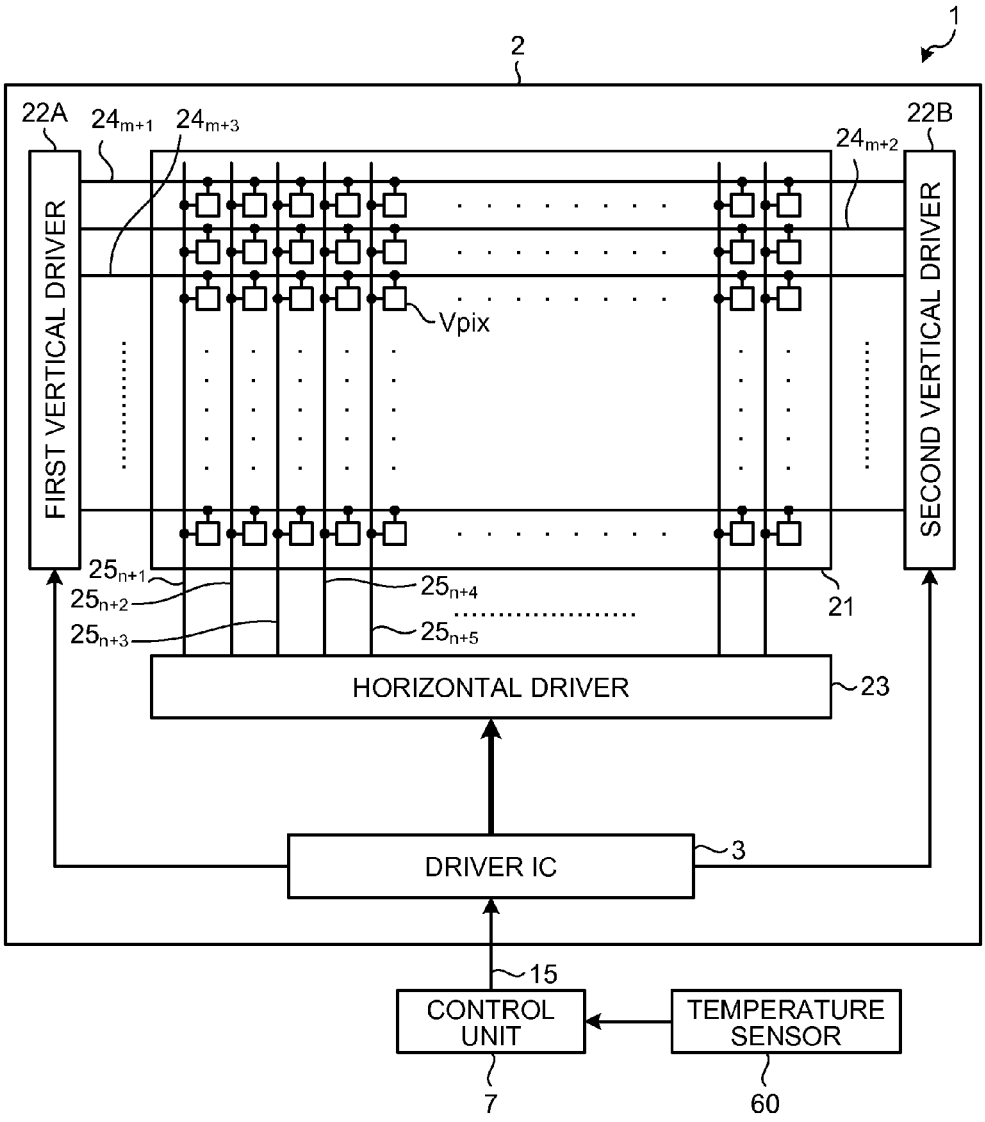
FIG. 3 is a block diagram of an example of a system configuration of the liquid-crystal display device illustrated in FIG. 1.
Figure 4:
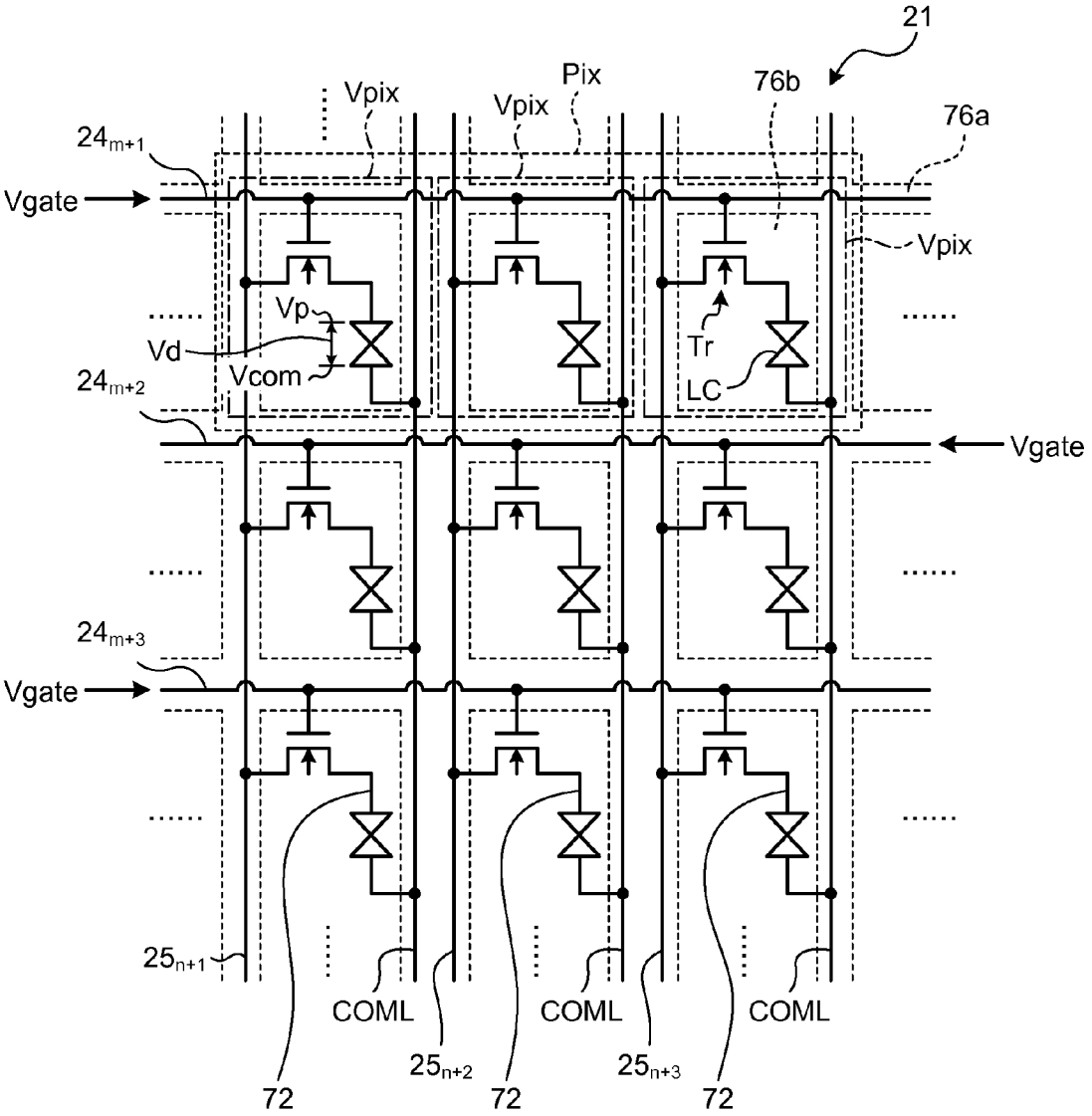
FIG. 4 is a circuit diagram of an example of a driving circuit for driving a pixel.

1. Liquid-crystal display device according to an embodiment
2. Evaluation example
3. Application example
4. Aspects of the present disclosure 1. Liquid-Crystal Display Device According to an Embodiment FIG. 1 is an overall perspective view of a liquid-crystal display device according to an embodiment of the present disclosure, and FIG. 2 is an exploded perspective view of the liquid-crystal display device according to an embodiment. FIG. 3 is a block diagram of an example of a system configuration of the liquid-crystal display device illustrated in FIG. 1, and FIG. 4 is a circuit diagram of an example of a driving circuit for driving a pixel. FIGS. 1 and 2 are schematic diagrams, and hence dimensions and shapes are not necessarily identical to those of the actual ones. A configuration of a liquid-crystal display device 1 according to the embodiment is described below with reference to FIGS. 1 to 4.

The liquid-crystal display device 1 is a display device employing a liquid crystal display (LCD) panel. Depending on a display scheme, the liquid-crystal display device 1 can be classified as a transmissive type and a reflective type. The liquid-crystal display device 1 according to the embodiment is a liquid-crystal display device of the transmissive type or a semi-transmissive type having features of both the transmissive type and the reflective type. That is, the embodiment can be applied to a liquid-crystal display device so long as it performs a display of an image by using transmission light from a backlight provided on a backside of a screen, and is applied to a transmissive-type liquid-crystal display device in the following descriptions. However, the liquid-crystal display device 1 can also be applied to a reflective-type liquid-crystal display device.

As illustrated in FIGS. 1 to 4, the liquid-crystal display device 1 according to the embodiment includes a liquid-crystal display panel 2, a backlight 6, and a control unit 7. In the liquid-crystal display device 1, the liquid-crystal display panel 2 is mounted on the backlight 6, so that the liquid-crystal display panel 2 is illuminated by the backlight 6 to display an image on the liquid-crystal display panel 2. The liquid-crystal display device 1 further includes a flexible printed circuit (FPC) 15. The FPC 15 couples the liquid-crystal display panel 2 and the control unit 7. The FPC 16 transmits a control signal for controlling a display operation of the liquid-crystal display panel 2 output from the control unit 7 to the liquid-crystal display panel 2.

The liquid-crystal display panel 2 includes a liquid crystal layer (a layer including liquid crystal LC to be described later) between two transparent substrates. The liquid-crystal display panel 2 according to the embodiment is an FFS (Fringe Field Switching) mode liquid-crystal display panel. In the liquid-crystal display panel 2, pixel electrodes 72 and a common electrode COML are provided on one of the transparent substrates to form a part of respective pixels Vpix, which are arranged in a matrix form. The liquid-crystal display panel 2 further includes a color filter provided on at least one of the two transparent substrates. The color filter includes a lattice-shaped black matrix 76*a* and color filters, such as R (Red), G (Green), and B (Blue), provided at opening portions 76*b* of the black matrix 76*a*, and the color filters are arranged corresponding to pixels Vpix, respectively. The liquid-crystal display panel 2 includes openings formed on the pixel electrodes 72 or on the common electrode COML, and drives the liquid crystal with electric fields (fringe electric fields) leaking from the openings. The liquid-crystal display panel 2 displays an image by switching transmitting and blocking the light at each pixel Vpix based on a control signal from the control unit 7. In the liquid-crystal display panel 2, an area where the pixels Vpix are arranged in a matrix form is defined as a display area 21. In the liquid-crystal display panel 2, a surface where the display area 21 is arranged, that is, a surface having the largest area (a panel surface, a front surface) is arranged in substantially parallel to an irradiation surface of the backlight 6. In the embodiment, the liquid-crystal display panel 2 is described as an FFS mode; however, the liquid-crystal display panel 2 can also employ IPS (In-Plane Switching) mode, a TN (Twisted Nematic) mode, an OCB (Optically Compensated Bend, Optically Compensated Birefringence) mode, or an ECB (Electrically Controlled Birefringence) mode.

The backlight 6 is arranged facing a rear surface side (a surface opposite to the surface on which the image is displayed) of the liquid-crystal display panel 2, and irradiates light on the liquid-crystal display panel 2. The backlight 6 includes a light source that outputs the light and a light guide plate that receives the light output from the light source and guides the light toward the liquid-crystal display panel 2. As the light source, an LED (Light Emitting Diode) or a fluorescent light can be used. The light source is coupled to a power source via a flexible cable 43 illustrated in FIG. 1. In the embodiment, the LED or the fluorescent light and the light guide plate is employed as the backlight 6 to output the light from an emitting surface of the light guide plate; however, the embodiment is not limited thereto. As the backlight 6, a point light source such as an LED or a line light source such as a cold cathode fluorescent lamp (CCFL) can also be used. The backlight 6 can also be configured to incident the light to the entire surface of the display surface of the liquid-crystal display panel 2 by arranging a plurality of point light sources or line light sources.

Driving System for Driving Liquid-Crystal Display Panel

A structure of each pixel Vpix in the liquid-crystal display panel 2 is described below with reference to FIGS. 3 and 4. The liquid-crystal display panel 2 includes a plurality of pixels Vpix, a driver IC 3, a horizontal driver (horizontal driving circuit) 23, and vertical drivers (vertical driving circuits) 22A and 22B. The driving circuit unit for driving the pixels Vpix includes the horizontal driver 23 and the vertical drivers 22A and 22B.

As illustrated in FIG. 3, the liquid-crystal display panel 2 has a matrix (matrix shape) structure in which the pixels Vpix including the liquid crystal layer (liquid crystal LC to be described later) are arranged in M rows by N columns in the display area 21. In the embodiment, the row indicates a pixel row including N pixels Vpix arranged in one direction. The column indicates a pixel column including M pixels Vpix arranged in a direction perpendicular to the direction in which the row is arranged. Values of M and N are determined based on a display resolution in a vertical direction and a display resolution in a horizontal direction. In the pixel Vpix illustrated in FIG. 4, color areas of three colors of R, G, and B correspond to a pixel Pix as a set.

In the liquid-crystal display panel 2, scanning lines $\mathbf{24}_1$, $\mathbf{24}_2$, $\mathbf{24}_3$, . . . , and $\mathbf{24}_M$ are wired for each row, and signal lines $\mathbf{25}_1$, $\mathbf{25}_2$, $\mathbf{25}_3$, . . . , and $\mathbf{25}_N$ are wired for each column with respect to the array of M rows by N columns of the pixels Vpix. Hereinafter, in the embodiment, the scanning lines $\mathbf{24}_1$, $\mathbf{24}_2$, $\mathbf{24}_3$, . . . , and $\mathbf{24}_M$ may be representatively denoted as scanning line 24 or scanning line $\mathbf{24}_m$, and the signal lines $\mathbf{25}_1$, $\mathbf{25}_2$, $\mathbf{25}_3$, . . . , and $\mathbf{25}_N$ may be representatively denoted as signal line 25 or signal line $\mathbf{25}_n$. In the embodiment, the scanning lines $\mathbf{24}_1$, $\mathbf{24}_2$, $\mathbf{24}_3$, . . . , and $\mathbf{24}_M$ may be representatively denoted as scanning lines $\mathbf{24}_{m+1}$, $\mathbf{24}_{m+2}$, $\mathbf{24}_{m+3}$, . . . , and the signal lines $\mathbf{25}_1$, $\mathbf{25}_2$, $\mathbf{25}_3$, . . . , and $\mathbf{25}_n$ may be representatively denoted as signal lines $\mathbf{25}_{n+1}$, $\mathbf{25}_{n+2}$, $\mathbf{25}_{n+3}$, . . . . When viewed from a viewing direction that intersects with a display surface of the liquid-crystal display panel 2, the scanning line 24 and the signal line 25 are arranged in an area that is overlapped with the black matrix 76*a* of a color filter (see FIG. 4). In the liquid-crystal display panel 2, the opening portion 76*b* is defined as an area where the black matrix 76*a* is not arranged.

The pixel Vpix includes a thin film transistor (TFT) Tr and liquid crystal LC. The thin film transistor Tr is an n-channel MOS (Metal Oxide Semiconductor) TFT in this example. One of a source and a drain of the thin film transistor Tr is coupled to one of the signal lines $\mathbf{25}_{n+1}$, $\mathbf{25}_{n+2}$, and $\mathbf{25}_{n+3}$, a gate thereof is coupled to one of the scanning lines $\mathbf{24}_{m+1}$, $\mathbf{24}_{m+2}$, and $\mathbf{24}_{m+3}$, and the other of the source and the drain is coupled to the pixel electrode 72.

The liquid crystal LC is provided between the pixel electrode 72 and the common electrode COML. The pixel electrode 72 is coupled to the thin film transistor Tr, and is applied with a pixel potential Vp from the thin film transistor Tr, separately for each pixel Vpix. The common electrode COML is applied with a common potential Vcom of a direct-current voltage, which is common to all pixels.

Control signals from the control unit 7, such as a master clock, a horizontal synchronization signal, and a vertical synchronization signal, are input to the liquid-crystal display panel 2, and supplied to the driver IC 3. Further, a temperature sensor 60 is coupled to the control unit 7. The temperature sensor 60 is used in a gradation control to be described later. The temperature sensor 60, which is preferably provided in proximity to the liquid-crystal display panel 2, detects a temperature in a usage environment of the liquid-crystal display panel 2. The temperature sensor 60 outputs a detection result to the control unit 7.

The driver IC 3 converts (boosts) levels of the master clock, the horizontal synchronization signal, and the vertical synchronization signal having a voltage amplitude of an external power source into levels of a voltage amplitude of an internal power source required to drive the liquid crystal, to generate a master clock, a horizontal synchronization signal, and a vertical synchronization signal. The driver IC 3 supplies the generated master clock, horizontal synchronization signal, and vertical synchronization signal to the first vertical driver 22A, the second vertical driver 22B, and the horizontal driver 23. The driver IC 3 further generates the common potential Vcom to be commonly supplied to the pixels, and supplies the generated common potential Vcom to the common electrode COML.

Each of the first vertical driver 22A and the second vertical driver 22B includes a shift register to be described later, and further includes a latch circuit and the like. The latch circuit of each of the first vertical driver 22A and the second vertical driver 22B sequentially samples and latches display data output from the driver IC 3 in synchronization with a vertical clock pulse within one horizontal period. Each of the first vertical driver 22A and the second vertical driver 22B sequentially outputs digital data of one line latched in the latch circuit as a vertical scanning pulse, and sequentially selects the pixels Vpix in units of row by supplying the vertical scanning pulse to the scanning lines $\mathbf{24}_{m+1}$, $\mathbf{24}_{m+2}$, $\mathbf{24}_{m+3}$, . . . of the liquid-crystal display panel 2. The first vertical driver 22A and the second vertical driver 22B are arranged to sandwich the scanning lines $\mathbf{24}_{m+1}$, $\mathbf{24}_{m+2}$, $\mathbf{24}_{m+3}$, . . . in a direction along which the scanning lines $\mathbf{24}_{m+1}$, $\mathbf{24}_{m+2}$, $\mathbf{24}_{m+3}$, . . . are extended. For example, each of the first vertical driver 22A and the second vertical driver 22B sequentially outputs the digital data from a vertical scanning upper direction nearer a top of the liquid-crystal display panel 2 of the scanning lines $\mathbf{24}_{m+1}$, $\mathbf{24}_{m+2}$, $\mathbf{24}_{m+3}$, . . . to a vertical scanning lower direction nearer a bottom of the liquid-crystal display panel 2. Alternatively, each of the first vertical driver 22A and the second vertical driver 22B can also sequentially outputs the digital data from the vertical scanning lower direction nearer the bottom of the liquid-crystal display panel 2 of the scanning lines $\mathbf{24}_{m+1}$, $\mathbf{24}_{m+2}$, $\mathbf{24}_{m+3}$, . . . to the vertical scanning upper direction nearer the top of the liquid-crystal display panel 2.

For example, 8-bit digital video data of R (red), G (green), and B (blue) is supplied to the horizontal driver 23. The horizontal driver 23 writes the display data via the signal line 25 for each pixel, each group of a plurality of pixels, or all pixels all together with respect to the pixels Vpix of the row selected based on the vertical scanning by the first vertical driver 22A and the second vertical driver 22B.

In this manner, the wirings are formed in the liquid-crystal display panel 2, such as the signal lines $\mathbf{25}_{n+1}$, $\mathbf{25}_{n+2}$, and $\mathbf{25}_{n+3}$ for supplying a pixel signal to the thin film transistor Tr of each pixel Vpix illustrated in FIG. 4 as the display data, and the scanning lines $\mathbf{24}_{m+1}$, $\mathbf{24}_{m+2}$, $\mathbf{24}_{m+3}$, and the like for driving the thin film transistor Tr. The signal lines $\mathbf{25}_{n+1}$, $\mathbf{25}_{n+2}$, and $\mathbf{25}_{n+3}$ are extended on a plane parallel to the surface of the liquid-crystal display panel 2, and supply the pixel signals for displaying an image on the pixels Vpix.

The pixels Vpix are coupled to the other pixels Vpix that belong to the same row of the liquid-crystal display panel 2 by the scanning lines $\mathbf{24}_{m+1}$, $\mathbf{24}_{m+2}$, and $\mathbf{24}_{m+3}$. The odd-numbered scanning lines $\mathbf{24}_{m+1}$ and $\mathbf{24}_{m+3}$ among the scanning lines $\mathbf{24}_{m+1}$, $\mathbf{24}_{m+2}$, and $\mathbf{24}_{m+3}$ are coupled to the first vertical driver 22A, and are supplied with a vertical scanning pulse Vgate of a scanning signal to be described later from the first vertical driver 22A. The even-numbered scanning lines $\mathbf{24}_{m+2}$ and $\mathbf{24}_{m+4}$ among the scanning lines $\mathbf{24}_{m+1}$, $\mathbf{24}_{m+2}$, and $\mathbf{24}_{m+3}$ are coupled to the second vertical driver 22B, and are supplied with a vertical scanning pulse Vgate to be described later from the second vertical driver 22B. In this manner, the first vertical driver 22A and the second vertical driver 22B apply the vertical scanning pulse Vgate to the scanning lines $\mathbf{24}_{m+1}$, $\mathbf{24}_{m+2}$, and $\mathbf{24}_{m+3}$ in the scanning direction in an alternate manner. Further, the pixels Vpix are coupled to th other pixels Vpix that belong to the same column of the liquid-crystal display panel 2 by the signal lines $\mathbf{25}_{n+1}$, $\mathbf{25}_{n+2}$, and $\mathbf{25}_{n+3}$. The signal lines $\mathbf{25}_{n+1}$, $\mathbf{25}_{n+2}$, and $\mathbf{25}_{n+3}$ are coupled to the horizontal driver 23, and are supplied with the pixel signals from the horizontal driver 23. The common electrode COML is coupled to the driver IC 3, and is supplied with common potential Vcom from the driver IC 3. The pixels Vpix are also coupled to the other pixels Vpix that belong to the same column of the liquid-crystal display panel 2 via the common electrode COML.

The first vertical driver 22A and the second vertical driver 22B illustrated in FIG. 3 sequentially select one row (one horizontal line) among the pixels Vpix formed in a matrix shape on the liquid-crystal display panel 2 as a target of a display drive by applying the vertical scanning pulse Vgate to the gates of the thin film transistors Tr of the pixels Vpix via the scanning lines $\mathbf{24}_{m+1}$, $\mathbf{24}_{m+2}$, and $\mathbf{24}_{m+3}$. The horizontal driver 23 illustrated in FIG. 3 supplies the pixel signal to each pixel Vpix included in the one horizontal line sequentially selected by the first vertical driver 22A and the second vertical driver 22B via the signal lines $\mathbf{25}_{n+1}$, $\mathbf{25}_{n+2}$, and $\mathbf{25}_{n+3}$. Thus, these pixels Vpix perform display of one horizontal line in response to the supplied pixel signal.

The liquid-crystal display panel 2 (the liquid-crystal display device 1) adopts a driving method for inverting the polarity of a video signal at a predetermined cycle with reference to the common potential Vcom, in order to suppress degradation of a specific resistance (unique resistance value of material) of the liquid crystal due to a constant application of a direct-current voltage of the same polarity to the liquid crystal.

As a driving method for driving the liquid-crystal display panel, a column inversion method, a line inversion method, a dot inversion method, a frame inversion method, and the like are generally known. The column inversion method is a driving method that inverts the polarity of the video signal at a time cycle of 1 V (V is a vertical period) corresponding to one column (one pixel column). The line inversion method is a driving method that inverts the polarity of the video signal at a time cycle of 1 H (H is a horizontal period) corresponding to one line (one pixel row). The dot inversion method is a driving method that alternately inverts the polarity of the video signal for each of pixels adjacent to each other on the left, right, top, and bottom. The frame inversion method is a driving method that inverts the polarity of the video signal to be written in all pixels in the same polarity at once for each frame corresponding to one picture. The liquid-crystal display panel 2 is configured to adopt any one of the driving methods described above.

Display Control by Control Unit

A display control by the control unit 7 is described below with reference to FIGS. 5 and 6. As described above, the pixel potential Vp is applied to the pixel electrode 72 from the thin film transistor Tr, and the common potential Vcom is applied to the common electrode COML from the driver IC 3. A potential difference between the common potential Vcom and the pixel potential Vp is a driving voltage Vd illustrated in FIG. 4, and the control unit 7 controls the gradation of each pixel Vpix by appropriately adjusting the voltage value of the driving voltage Vd. That is, the control unit 7 inputs a control signal corresponding to the driving voltage Vd to the driver IC 3, and controls the gradation of each pixel Vpix by the driving circuit unit including the horizontal driver 23 and the vertical drivers 22A and 22B.

The gradation of each pixel Vpix has, for example, 256 gradations from 0 gradation that is the minimum gradation value to 255 gradation that is the maximum gradation value, which performs a so-called "8-bit display". Therefore, as each color of R, G, and B performs the 8-bit display, the pixel Pix can represent a 24-bit display, that is, about 16.77 million colors.

The control unit 7 controls the display operation of each pixel Vpix at a frame rate with which the number of frames per unit time is equal to a predetermined number, and controls the gradation of each pixel Vpix for each predetermined frame cycle. Specifically, the control unit 7 performs a 60-Hz driving that drives each pixel Vpix at a frame rate with which the number of frames per second is equal to 60 frames. The control unit 7 applies the driving voltage corresponding to the gradation of the pixel Vpix at every frame cycle (13.3 ms) in the 60-Hz driving.

In this manner, the control unit 7 executes the display control of each pixel Vpix by appropriately changing the voltage value of the driving voltage Vd to be applied to each pixel Vpix according to the gradation of each pixel Vpix at a predetermined frame cycle.

The 256 gradation values have a minimum gradation value of 0 gradation where the pixel Vpix is dark and a maximum gradation value of 255 gradation where the pixel is bright. The pixel Vpix has the darkness of the minimum gradation value when the driving voltage Vd is the minimum voltage value. On the other hand, the pixel Vpix has the brightness of the maximum gradation value when the driving voltage Vd is the maximum voltage value. That is, the liquid-crystal display panel 2 adopts a normally black system in which the display becomes black (dark) without transmitting light when no driving voltage Vd is applied (when the driving voltage Vd is 0 V).

However, in the liquid-crystal display panel 2, when the temperature of the usage environment is low, a response speed of the liquid crystal LC is decreased. Therefore, in the liquid-crystal display device 1 according to the embodiment, a plurality of pieces of display control data are prepared according to the temperature of the usage environment for executing the display control of the pixel Vpix.

For example, two types of display control data are prepared according to the usage environment. One of the two types of the display control data is normal-temperature display control data D1 used when the temperature of the usage environment of the liquid-crystal display panel 2 is a normal temperature. The other is low-temperature display control data D2 used when the temperature of the usage environment of the liquid-crystal display panel 2 is a low temperature.

The normal-temperature display control data D1 is data in which a decrease in the response speed of the liquid crystal LC is not taken care of. Specifically, the normal-temperature display control data D1 is for a first frame rate, for example, data for a 60-Hz driving. In the first frame rate, 60 voltage values $Vd_1$ to $Vd_{60}$ are sequentially applied to 60 frames that is the number of frames per unit time. The 60 voltage values $Vd_1$ to $Vd_{60}$ to be applied are sometimes the same voltage value and other times different voltage values as each of the voltage values corresponds to the gradation of each of the pixels Vpix. In this case, when the unit time is T (for example, 1 s), the first frame rate has one frame cycle of Ta (for example, 16.6 ms).

The low-temperature display control data D2 is data in which a decrease in the response speed of the liquid crystal LC is taken care of. Specifically, the low-temperature display control data D2 is for a second frame rate, for example, data for a 30-Hz driving. In the second frame rate, 30 voltage values $Vd_1$ to $Vd_{30}$ are sequentially applied to 30 frames that is the number of frames per unit time. The 30 voltage values $Vd_1$ to $Vd_{30}$ to be applied are sometimes the same voltage value and other times different voltage values as each of the voltage values corresponds to the gradation of each of the pixels Vpix. In this case, when the unit time is T (for example, 1 s), the second frame rate has one frame cycle of Tb (for example, 33.3 ms). At this time, the one frame cycle Tb in the second frame rate is longer than the one frame cycle Ta in the first frame rate.

In this manner, the second frame rate of the low-temperature display control data D2 is smaller than the first frame rate of the normal-temperature display control data D1. That is, the second frame rate of the low-temperature display control data D2 is a frame rate obtained by dividing the number of frames of the first frame rate by an integer equal to or larger than 2 (in the embodiment, the integer is 2).

The control unit 7 switches a display control mode between a normal-temperature display control mode (first display control mode) for executing the display control by using the normal-temperature display control data D1 and a low-temperature display control mode (second display control mode) for executing the display control by using the low-temperature display control data D2 based on the temperature detected by the temperature sensor 60.

Upon performing the normal-temperature display control mode, the control unit 7 controls the gradation of each pixel Vpix of the liquid-crystal display panel 2 based on the normal-temperature display control data D1 for each frame cycle Ta. That is, the control unit 7 outputs a control signal (a video signal) based on the normal-temperature display control data D1 to the driver IC 3. Therefore, in the normal-temperature display control mode, the gradation of each pixel Vpix can be displayed at the first frame rate.

On the other hand, upon performing the low-temperature display control mode, the control unit 7 controls the gradation of each pixel Vpix of the liquid-crystal display panel 2 based on the low-temperature display control data D2 for each frame cycle Tb. That is, the control unit 7 outputs a control signal (a video signal) based on the low-temperature display control data D2 to the driver IC 3. Therefore, in the low-temperature display control mode, the gradation of each pixel Vpix can be displayed at the second frame rate.

Upon performing the normal-temperature display control mode and the low-temperature display control mode, the control unit 7 can perform an overdrive. In the overdrive, in order to increase the response speed of the liquid crystal LC when the response speed of the liquid crystal LC decreases, a driving voltage higher than a target driving voltage corresponding to a target gradation of the pixel Vpix is applied for a predetermined period of time. The predetermined period of time is, for example, one frame cycle. In the normal-temperature display control mode, the driving voltage Vd is applied only for the frame cycle Ta when performing the overdrive, and in the low-temperature display control mode, the driving voltage Vd is applied only for the frame cycle Tb when performing the overdrive. At this time, the one frame cycle Tb of the low-temperature display control mode is longer than the one frame cycle Ta of the normal-temperature display control mode, and hence the application time of the driving voltage applied at the time of performing the overdrive is longer in the low-temperature display control mode than in the normal-temperature display control mode.

When applying the driving voltage Vd that is higher than the target driving voltage Vd at the time of performing the overdrive, the control unit 7 can apply the driving voltage Vd corresponding to the gradation of two times the target gradation, apply the driving voltage Vd obtained by multiplying the target driving voltage Vd by a predetermined coefficient (so-called "overdrive coefficient"), or apply the driving voltage Vd corresponding to the maximum gradation value.

Figure 7:
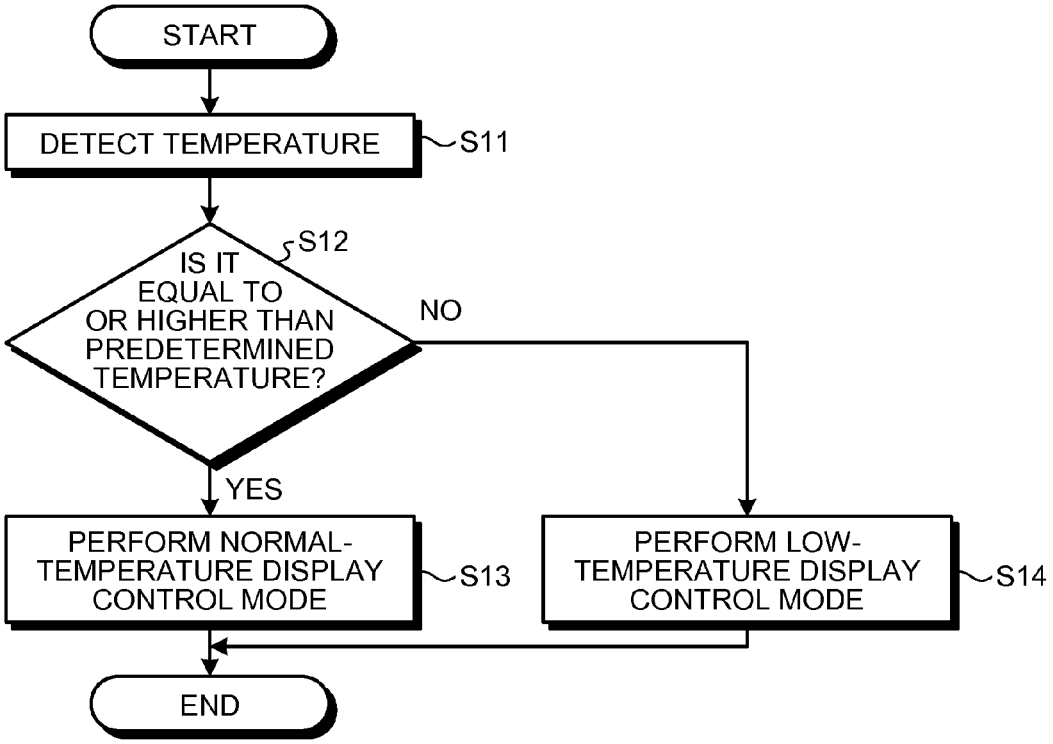
FIG. 7 is a flowchart of an example of a display control operation performed by a control unit.

A switch control of the display control mode by the control unit 7 is described below with reference to FIG. 7. The control unit 7 detects the temperature of the usage environment of the liquid-crystal display panel 2 by the temperature sensor 60 (Step S11). Thereafter, the control unit 7 determines whether the detected temperature is equal to or higher than a predetermined temperature (Step S12). The predetermined temperature is a temperature at which the response speed of the liquid crystal LC is decreased, and is set to an arbitrary temperature. The predetermined temperature is, for example, −30° C. When it is determined that the detected temperature is equal to or higher than the predetermined temperature (YES at Step S12), the control unit 7 executes the normal-temperature display control mode (Step S13), and ends the execution of the switch control. On the other hand, when it is determined that the detected temperature is lower than the predetermined temperature (NO at Step S12), the control unit 7 performs the low-temperature display control mode (Step S14), and ends the execution of the switch control. The control unit 7 repeatedly executes the switch control for each predetermined cycle.

The control unit 7 sets the application time of the driving voltage Vd to be applied at the time of performing the overdrive in the normal-temperature display control mode and the low-temperature display control mode shorter than the response time of the liquid crystal layer. The response time of the liquid crystal layer (the liquid crystal LC) is a time required to change from the minimum gradation value to the maximum gradation value (or a time required to change from the maximum gradation value to the minimum gradation value), which changes according to the response speed of the liquid crystal LC. That is, when the response speed of the liquid crystal LC is slow, the response time of the liquid crystal layer is fast, and when the response speed of the liquid crystal LC is increased, the response time of the liquid crystal layer is decreased. Specifically, when the frame rate is 60 frames and the response time of the liquid crystal layer is shorter than 33.3 ms (two frame cycles), the application time of the driving voltage at the time of performing the overdrive can be set to 16.6 ms (one frame cycle) by setting the mode to the normal-temperature display control mode. On the other hand, when the frame rate is 60 frames and the response time of the liquid crystal layer is equal to or longer than 33.3 ms (two frame cycles), the application time of the driving voltage at the time of performing the overdrive can be set to 33.3 ms (one frame cycle) by setting the mode to the low-temperature display control mode.

In this manner, the liquid-crystal display device 1 switches the display control mode between the normal-temperature display control mode and the low-temperature display control mode based on the detection result from the temperature sensor 60. Therefore, when the response speed of the liquid crystal layer is slow, the control unit 7 can change the frame rate to the second frame rate that is shorter than the first frame rate by switching the display control mode to the low-temperature display control mode, so that the frame cycle per frame is increased. As a result, even when the response speed of the liquid crystal LC is slow, the control unit 7 can appropriately drive the liquid crystal layer within the frame cycle by increasing the frame cycle, and suppress skipping of an image formed by the pixels. Further, when the application time of the driving voltage Vd is increased at the time of performing the overdrive, the control unit 7 does not need to change the number of frames used in performing the overdrive. In this manner, the control unit 7 can increase the application time of the driving voltage Vd at the time of performing the overdrive without increasing the number of frames used in the overdrive, and hence the response speed of the liquid crystal layer can be increased while suppressing an increase of the load on the driving circuit unit that drives each pixel Vpix.

Further, in the liquid-crystal display device 1, the control unit 7 can switch the display control mode between the normal-temperature display control mode and the low-temperature display control mode based on the temperature detected by the temperature sensor 60. Therefore, at the ambient temperature at which the response speed of the liquid crystal LC decreases, the liquid-crystal display device 1 can execute a display control of the pixel Vpix in the low-temperature display control mode.

In the liquid-crystal display device 1, the control unit 7 can set the application time of the driving voltage Vd to be applied at the time of performing the overdrive shorter than the response time of the liquid crystal layer. Therefore, the control unit 7 can switch the display control mode to an appropriate display control mode according to the response time of the liquid crystal layer, and hence the application time of the driving voltage Vd to be applied at the time of performing the overdrive can be set to an appropriate application time.

Although the display control mode is switched between the normal-temperature display control mode and the low-temperature display control mode by using the temperature sensor 60 in the liquid-crystal display device 1 according to the embodiment, the embodiment is not limited to using the temperature sensor 60. That is, any detection unit can be used so long as it is a status detection unit that can directly or indirectly detect a status of the response speed of the liquid crystal LC.

Although the display control mode is switched between the normal-temperature display control mode and the low-temperature display control mode by using two types of display control data including the normal-temperature display control data D1 and the low-temperature display control data D2 in the liquid-crystal display device 1 according to the embodiment, the embodiment is not limited to this configuration. For example, the display control mode can be appropriately switched among three or more display control modes by preparing three or more types of display control data. For example, it can be configured to perform a 120-Hz driving at in normal temperature where the detected temperature is equal to or higher than a first predetermined temperature (for example, −10° C.), perform a 60-Hz driving in a low temperature where the detected temperature is equal to or higher than a second predetermined temperature (for example, −30° C.) that is lower than the first predetermined temperature, and perform a 30-Hz driving in a low temperature where the detected temperature is below the second predetermined temperature.

Although the first frame rate is defined as 60 frames and the second frame rate is defined as 30 frames in the liquid-crystal display device 1 according to the embodiment, the embodiment is not limited to this configuration. The second frame rate of the low-temperature display control data D2 can be a frame rate obtained by dividing the number of frames of the first frame rate by an integer equal to or larger than 2. Therefore, for example, the first frame rate can be defined as 120 frames, and the second frame rate can be defined as 60 frames.

2. Evaluation Example

Figure 8:
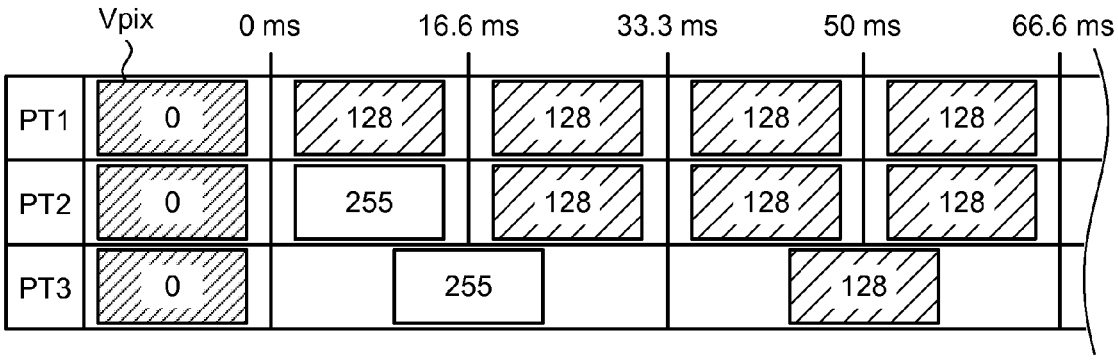
FIG. 8 is an explanatory diagram of a display at the time of performing an overdrive.
Figure 9:
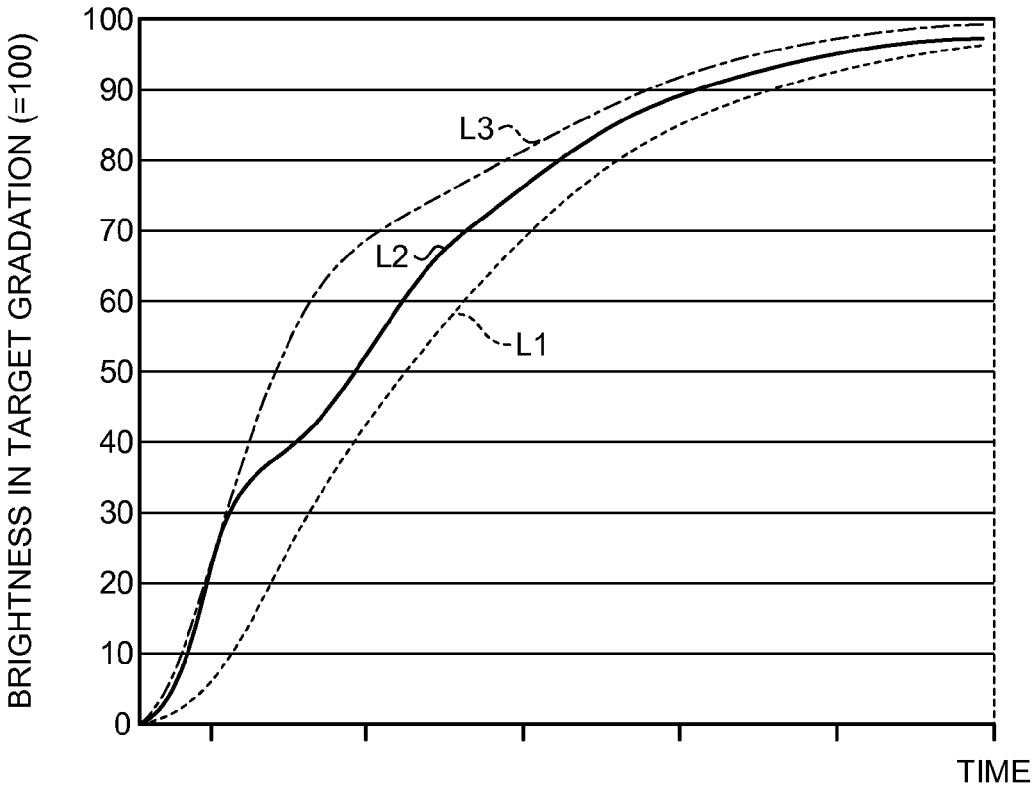
FIG. 9 is a graph representing brightness at a target gradation that changes with time.

In the present evaluation example, in order to evaluate the operation effect of the liquid-crystal display device 1 according to the embodiment, brightness at a target gradation that changes with time in the liquid-crystal display device 1 according to the embodiment is compared with brightness at a target gradation that changes with time in a related liquid-crystal display device. FIG. 8 is an explanatory diagram of a display at the time of performing the overdrive. FIG. 9 is a graph representing brightness at a target gradation that changes with time.

In FIG. 8, PT1 indicates a display status in the related liquid-crystal display device when the display control of the pixel Vpix is executed without performing the overdrive. The display control of the related liquid-crystal display device is a display control corresponding to the normal-temperature display control mode according to the embodiment. In the PT1, the pixel Vpix can be displayed in 256 gradations, and the frame rate is set to 60 frames. Further, in the PT1, the driving voltage Vd is applied such that the pixel Vpix becomes from 0 gradation to 128 gradation. As illustrated in FIG. 8, in the PT1, because the overdrive is not performed, the driving voltage Vd corresponding to 128 gradation is applied to the pixel Vpix from the first frame.

In FIG. 8, PT2 indicates a display status in the related liquid-crystal display device when the display control of the pixel Vpix is executed by performing the overdrive. The display control of the related liquid-crystal display device is a display control corresponding to the normal-temperature display control mode according to the embodiment. In the PT2 also, the pixel Vpix can be displayed in 256 gradations, and the frame rate is set to 60 frames. Further, in the PT2 also, the driving voltage Vd is applied such that the pixel Vpix becomes from 0 gradation to 128 gradation. As illustrated in FIG. 8, in the PT2, because the overdrive is performed, the driving voltage Vd corresponding to 255 gradation, which is higher than the driving voltage Vd corresponding to 128 gradation is applied to the first frame of the pixel Vpix. Thereafter, the driving voltage Vd corresponding to 128 gradation is applied to the second frame and after of the pixel Vpix. At this time, the driving voltage Vd corresponding to 255 gradation is applied just by 16.6 ms (one frame cycle Ta).

In FIG. 8, PT3 indicates a display status in the liquid-crystal display device 1 according to the embodiment when the display control of the pixel Vpix is executed by performing the overdrive. The display control of the liquid-crystal display device 1 according to the embodiment is a display control in the low-temperature display control mode. In the PT3, the pixel Vpix can be displayed in 256 gradations, and the frame rate is set to 30 frames. Further, in the PT3, the driving voltage Vd is applied such that the pixel Vpix becomes from 0 gradation to 128 gradation. As illustrated in FIG. 8, in the PT3, because the overdrive is performed, the driving voltage Vd corresponding to 255 gradation, which is higher than the driving voltage Vd corresponding to 128 gradation is applied to the first frame of the pixel Vpix. Thereafter, the driving voltage Vd corresponding to 128 gradation is applied to the second frame and after of the pixel Vpix. At this time, the driving voltage Vd corresponding to 255 gradation is applied just by 33.3 ms (one frame cycle Tb).

A temporal change of the brightness to the target gradation from the PT1 to the PT3 illustrated in FIG. 8 is described next with reference to the graph illustrated in FIG. 9. In the graph illustrated in FIG. 9, the horizontal axis represents time, and the vertical axis represents brightness (=100) at the target gradation. In FIG. 9, the temperature in the usage environment of the liquid-crystal display device 1 is set to a temperature that is lower than a predetermined temperature.

In FIG. 9, L1 indicates the temporal change of the brightness to the target gradation in the PT1 illustrated in FIG. 8. L2 indicates the temporal change of the brightness to the target gradation in the PT2 illustrated in FIG. 8. L3 indicates the temporal change of the brightness to the target gradation in the PT3 illustrated in FIG. 8.

As illustrated in FIG. 9, comparing the brightness at a predetermined time among the L1, the L2, and the L3, it is found that the L3 exhibits the highest brightness, followed by the L2, and the L3 exhibits the lowest brightness. Accordingly, it is confirmed that the liquid-crystal display device 1 according to the embodiment can swiftly arrive at the brightness at the target gradation by performing the low-temperature display control mode in a low-temperature usage environment.

3. Application Example

Figure 10:
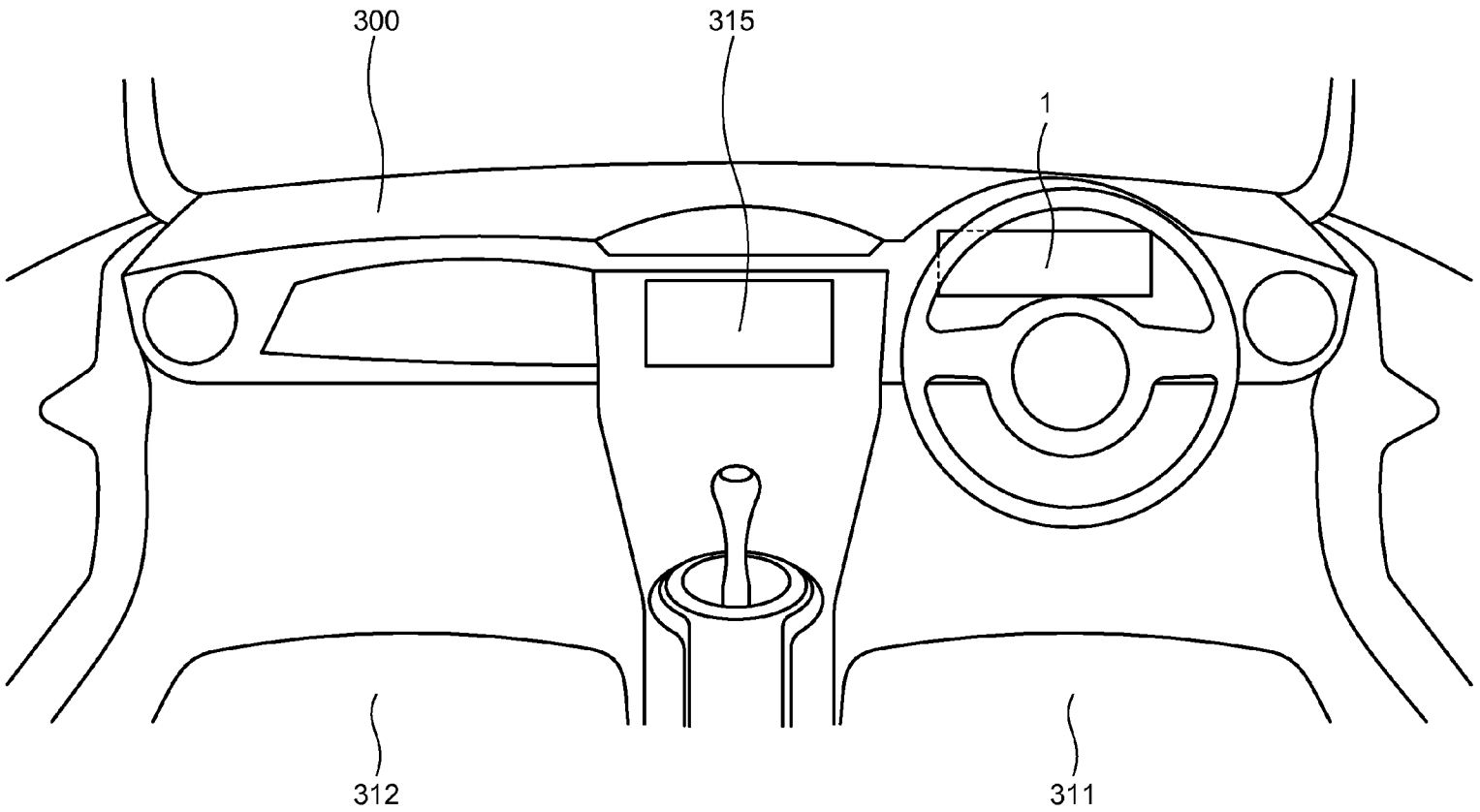
FIG. 10 illustrates a state where the liquid-crystal display device according to the embodiment is installed in a dashboard of a vehicle.
Figure 11:
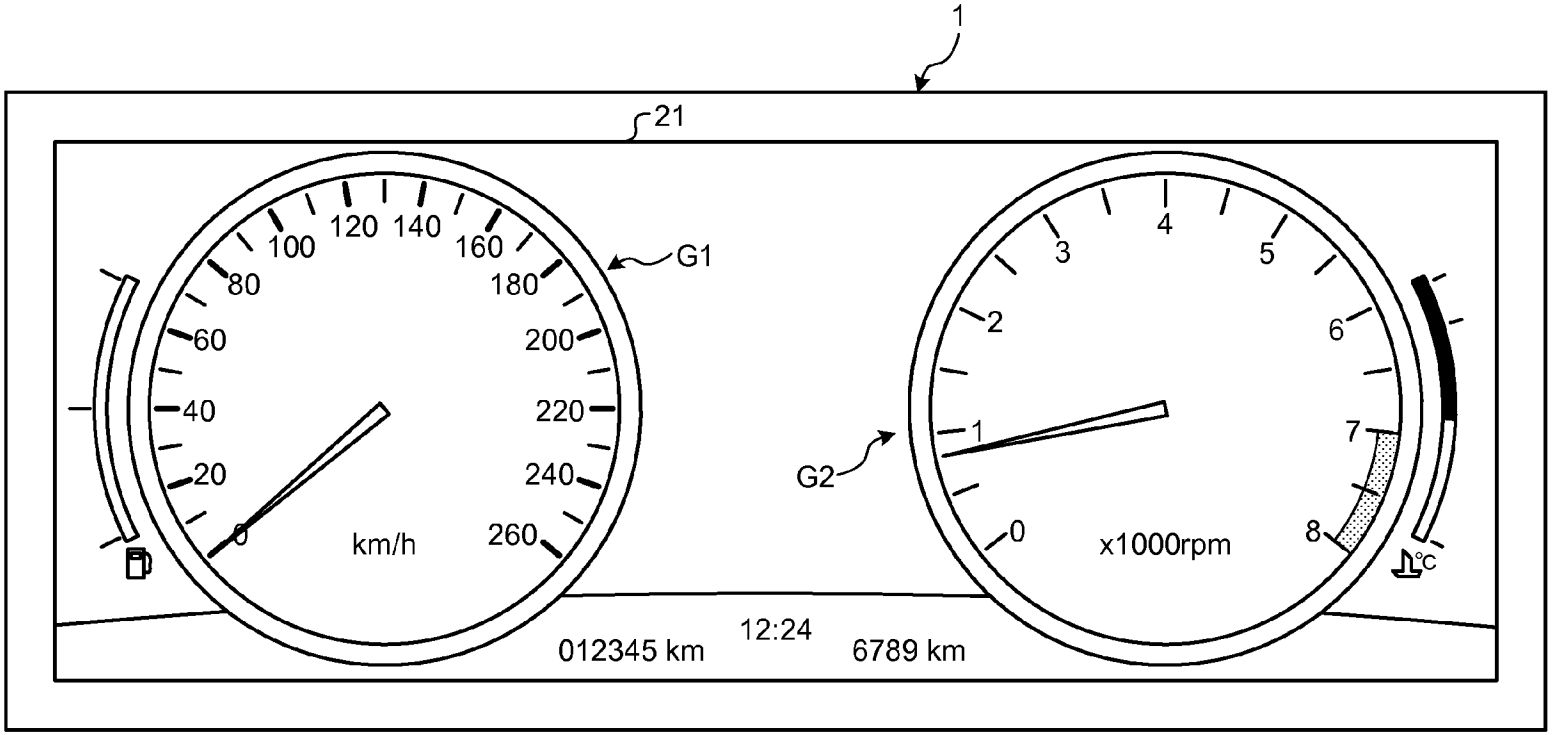
FIG. 11 is an example of an image displayed on the liquid-crystal display device according to the embodiment.

An application example of the liquid-crystal display device 1 described in the embodiment is explained below with reference to FIGS. 10 and 11. FIG. 10 illustrates a state where the liquid-crystal display device according to the embodiment is installed in a dashboard of a vehicle. FIG. 11 is an example of an image displayed on the liquid-crystal display device according to the embodiment.

As illustrated in FIG. 10, for example, the liquid-crystal display device 1 according to the embodiment is installed in a dashboard 300 on a driver's side in a vehicle. In this case, the liquid-crystal display device 1 is used as an instrument panel that can display speed and rpm. As illustrated in FIG. 11, when the liquid-crystal display device 1 is used as the instrument panel, an image G1 of a speedometer is displayed on one side (the left side in FIG. 11) in a longitudinal direction of a display area 21 of the liquid-crystal display device 1, and an image G2 of a tachometer is displayed on the other side (the right side in FIG. 11) in the longitudinal direction.

Further, the liquid-crystal display device 1 according to the embodiment can be applied to a car navigation device 315 installed in the dashboard 300 between a driver seat 311 and a passenger seat 312. In this case, the liquid-crystal display device 1 of the car navigation device 315 is used for a navigation display, a music-operation screen display, a movie play display, or the like.

The liquid-crystal display device 1 according to the embodiment can be applied to electronic apparatuses in various fields such as television devices, digital cameras, notebook PCs, mobile devices including mobile phones, video cameras, or the like, as well as the instrument panel and the car navigation device 315. In other words, the liquid-crystal display device 1 according to the embodiment can be applied to electronic apparatuses in any field, in which a video signal that is externally input or a video signal that is internally generated is displayed as an image or a video. The electronic apparatus includes a control device that supplies a video signal to the liquid-crystal display panel and controls an operation of the liquid-crystal display panel.

The embodiment is not limited to the above descriptions. Constituent elements in the above embodiments include those that can be easily conceived by persons skilled in the art, those that are substantially identical thereto, and those within the range of equivalence. Furthermore, these constituent elements can be variously omitted, replaced, or modified without departing from the scope of the above embodiments.

4. Aspects Of The Present Disclosure

The present disclosure includes aspects as follows.

(1) A liquid-crystal display device comprising:

a pixel electrode provided for each pixel;

a common electrode for supplying a common potential to the pixel;

a liquid crystal layer arranged between the pixel electrode and the common electrode;

a driving circuit unit that applies a driving voltage between the common electrode and the pixel electrode for each frame cycle;

a status detection unit that detects a status of a response speed of the liquid crystal layer; and a control unit that controls a display operation for displaying the pixel by controlling the driving voltage applied by the driving circuit unit for each frame cycle, wherein the control unit performs a first display control mode when a response speed of the liquid crystal layer is equal to or higher than a predetermined speed and performs a second display control mode when the response speed of the liquid crystal layer is lower than the predetermined speed, based on a detection result from the status detection unit, in the first display control mode, the control unit executes a display control at a first frame rate with which a number of frames per unit time is equal to a predetermined number and applies the driving voltage for each frame cycle at the first frame rate, and in the second display control mode, the control unit executes a display control at a second frame rate obtained by dividing the number of frames at the first frame rate by an integer equal to or larger than 2, applies the driving voltage for each frame cycle at the second frame rate, and sets the driving voltage to be applied to a voltage higher than a target driving voltage corresponding to a target gradation of the pixel.

(2) The liquid-crystal display device according to (1), wherein the status detection unit includes a temperature detection unit that measures a temperature of a usage environment, and the control unit switches a display control mode to the first display control mode when the temperature detected by the temperature detection unit is equal to or higher than a predetermined temperature, and switches the display control mode to the second display control mode when the temperature detected by the temperature detection unit is lower than a predetermined temperature.

(3) The liquid-crystal display device according to (1), wherein the control unit sets an application time of the driving voltage to be shorter than a response time of the liquid crystal layer.

(4) An electronic apparatus comprising the liquid-crystal display device according to (1).

In order to achieve the above object, the present disclosure relates to a liquid-crystal display device including a pixel electrode provided for each pixel, a common electrode for supplying a common potential to the pixel, a liquid crystal layer arranged between the pixel electrode and the common electrode, a driving circuit unit that applies a driving voltage between the common electrode and the pixel electrode for each frame cycle, a status detection unit that detects a status of a response speed of the liquid crystal layer, and a control unit that controls a display operation for displaying the pixel by controlling the driving voltage applied by the driving circuit unit for each frame cycle. The control unit performs a first display control mode when the response speed of the liquid crystal is equal to or higher than a predetermined speed, and performs a second display control mode when the response speed of the liquid crystal is lower than the predetermined speed. In the first display control mode, the control unit executes a display control at a first frame rate with which the number of frames per unit time is equal to a predetermined number and applies the driving voltage for each frame cycle at the first frame rate, and in the second display control mode, the control unit executes a display control at a second frame rate obtained by dividing the number of frames at the first frame rate by an integer equal to or larger than 2, applies the driving voltage for each frame cycle at the second frame rate, and sets the driving voltage to be applied to a voltage higher than a target driving voltage corresponding to a target gradation of the pixel.

In the liquid-crystal display device having the configuration described above and in the electronic apparatus including the liquid-crystal display device, when the response speed of the liquid crystal layer is slow, the control unit switches a display control mode to the second display control mode. Therefore, because the control unit can execute the display control at the second frame rate that is lower than the first frame rate by switching the display control mode to the second display control mode, the control unit can increase the frame cycle per a single frame. As a result, even when the response speed of the liquid crystal is slow, the control unit can appropriately drive the liquid crystal layer in the frame cycle by increasing the frame cycle, thus suppressing skipping of an image formed by the pixels. When an application time of the driving voltage is increased at the time of performing the second display control mode, the control unit does not need to change the number of frames to be used in the second display control mode. Accordingly, the control unit can increase the application time of the driving voltage at the time of performing the second display control mode without increasing the number of frames to be used in the second display control mode, and hence the response speed of the liquid crystal layer can be improved without necessitating an extra capacity of a memory for the driving circuit unit that drives each pixel.

According to the present disclosure, when the response speed of the liquid crystal layer is slow, the display control mode is switched to the second display control mode, so that the response speed of the liquid crystal layer can be improved by performing the overdrive without necessitating an extra capacity of a memory for the driving circuit unit.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A liquid-crystal display device comprising:

a pixel electrode provided for each pixel;

a common electrode for supplying a common potential to the pixel;

a liquid crystal layer arranged between the pixel electrode and the common electrode;

a driving circuit unit that applies a driving voltage between the common electrode and the pixel electrode for each frame cycle;

a status detection unit that detects a status of a response speed of the liquid crystal layer; and a control unit that controls a display operation for displaying the pixel by controlling the driving voltage applied by the driving circuit unit for each frame cycle, the control unit performs a first display control mode when a response speed of the liquid crystal layer is equal to or higher than a predetermined speed and performs a second display control mode when the response speed of the liquid crystal layer is lower than the predetermined speed, based on a detection result from the status detection unit, in the first display control mode, the control unit executes a display control at a first frame rate with which a number of frames per unit time is equal to a predetermined number and applies the driving voltage for each frame cycle at the first frame rate, and in the second display control mode, the control unit executes a display control at a second frame rate obtained by dividing the number of frames at the first frame rate by an integer equal to or larger than 2, applies the driving voltage for each frame cycle at the second frame rate, and sets the driving voltage to be applied to a voltage higher than a target driving voltage corresponding to a target gradation of the pixel.

2. The liquid-crystal display device according to claim 1, the status detection unit includes a temperature detection unit that measures a temperature of a usage environment, and the control unit switches a display control mode to the first display control mode when the temperature detected by the temperature detection unit is equal to or higher than a predetermined temperature, and switches the display control mode to the second display control mode when the temperature detected by the temperature detection unit is lower than a predetermined temperature.

3. The liquid-crystal display device according to claim 1, the control unit sets an application time of the driving voltage to be shorter than a response time of the liquid crystal layer.

* * * * *